US010034361B2

(12) United States Patent
Magnuson et al.

(10) Patent No.: US 10,034,361 B2
(45) Date of Patent: Jul. 24, 2018

(54) LINE-FREQUENCY ROTARY TRANSFORMER FOR COMPUTED TOMOGRAPHY GANTRY

(71) Applicant: Morpho Detection, LLC, Newark, CA (US)

(72) Inventors: Erik E. Magnuson, Cardiff, CA (US); Pedro Andres Garzon, Santa Clara, CA (US); Samit Kumar Basu, Fremont, CA (US)

(73) Assignee: SMITHS DETECTION, LLC, Newark, CA (US)

( * ) Notice: Subject to any disclaimer, the term of this patent is extended or adjusted under 35 U.S.C. 154(b) by 237 days.

(21) Appl. No.: 15/044,002

(22) Filed: Feb. 15, 2016

(65) Prior Publication Data

US 2017/0238405 A1 Aug. 17, 2017

(51) Int. Cl.

| | |
|---|---|
| ***H05G 1/10*** | (2006.01) |
| ***H01F 3/02*** | (2006.01) |
| ***H01F 27/245*** | (2006.01) |
| ***H01F 38/14*** | (2006.01) |
| ***H01F 38/18*** | (2006.01) |

(52) U.S. Cl.

CPC ..... *H05G 1/10* (2013.01); *H01F 3/02* (2013.01); *H01F 27/245* (2013.01); *H01F 38/14* (2013.01); *H01F 38/18* (2013.01)

(58) Field of Classification Search

CPC ... H01F 27/245; H01J 2027/2819; H05G 1/10
See application file for complete search history.

(56) References Cited

U.S. PATENT DOCUMENTS

| | | | |
|---|---|---|---|
| 1,629,311 | A | 5/1927 | Ruder |
| 4,321,572 | A | 3/1982 | Studer et al. |
| 5,608,771 | A | 3/1997 | Steigerwald et al. |
| 6,674,836 | B2 | 1/2004 | Harada et al. |
| 7,197,113 | B1 | 3/2007 | Katcha et al. |
| 7,634,046 | B2 | 12/2009 | Krumme |

(Continued)

FOREIGN PATENT DOCUMENTS

| | | | | |
|---|---|---|---|---|
| DE | 29503608 | U1 | 9/1995 | |
| WO | 2009147552 | A1 | 12/2009 | |
| WO | WO 2009/147550 | A1 * | 12/2009 | ..... H01F 38/18 |

OTHER PUBLICATIONS

Partial European Search Report corresponding to European Application No. 17000238, dated Jul. 21, 2017.

*Primary Examiner* — Don Wong
(74) *Attorney, Agent, or Firm* — Armstrong Teasdale LLP

(57) ABSTRACT

A line-frequency rotary transformer is provided, including a primary core and a secondary core. The primary core is magnetically couplable to the secondary core. The primary core includes a first plurality of E-core steel laminates arranged in a first ring couplable to a stator. The primary core includes a primary winding disposed within the first ring and configured to transmit line-frequency AC power. The secondary core includes a second plurality of E-core steel laminates arranged in a second ring couplable to a gantry. The gantry is rotatably couplable to the stator. The secondary core includes a secondary winding disposed within the second ring and is configured to receive a line-frequency AC power induced in the secondary winding through the primary core and the secondary core by the primary winding.

12 Claims, 6 Drawing Sheets

(56) References Cited

U.S. PATENT DOCUMENTS

| | | | |
|---|---|---|---|
| 7,826,586 | B2 | 11/2010 | Nakayama et al. |
| 7,848,482 | B2 | 12/2010 | Nakayama et al. |
| 8,824,624 | B2 | 9/2014 | Loef et al. |
| 2007/0188284 | A1 | 8/2007 | Dobbs |
| 2010/0128842 | A1 | 5/2010 | Meng |
| 2011/0074534 | A1 | 3/2011 | Loef et al. |
| 2011/0075797 | A1 | 3/2011 | Loef et al. |
| 2011/0080991 | A1 | 4/2011 | Scheel et al. |
| 2015/0333697 | A1 | 11/2015 | Taskov |
| 2015/0380947 | A1 | 12/2015 | Zhang et al. |

* cited by examiner

LINE-FREQUENCY ROTARY TRANSFORMER FOR COMPUTED TOMOGRAPHY GANTRY

BACKGROUND

The field of the disclosure relates generally to computed tomography (CT) systems and, more particularly, to a line-frequency rotary transformer for a CT gantry.

Generally, CT gantry systems include a stationary portion, referred to as a stator, and a gantry that rotates about the stator. The gantry houses X-ray source and X-ray detector components. The stator delivers power to the gantry to operate the CT gantry system.

Power for operating the CT gantry system can be transmitted from the stator to the gantry using various techniques. One technique utilizes contact slip rings that establish a mechanical conductive bridge between the stator and gantry. The mechanical conductive bridge is typically formed by a sliding contact, such as, for example, a conductive brush. Alternatively, a non-contacting slip ring may be utilized, referred to as a rotary transformer. The rotary transformer utilizes alternating magnetic fields to couple the stator to the gantry for power transmission.

BRIEF DESCRIPTION

In one aspect, a line-frequency rotary transformer is provided, including a primary core and a secondary core. The primary core is magnetically couplable to the secondary core. The primary core includes a first plurality of E-core steel laminates arranged in a first ring couplable to a stator. The primary core includes a primary winding disposed within the first ring and configured to transmit line-frequency AC power. The secondary core includes a second plurality of E-core steel laminates arranged in a second ring couplable to a gantry. The gantry is rotatably couplable to the stator. The secondary core includes a secondary winding disposed within the second ring and is configured to receive a line-frequency AC power induced in the secondary winding through the primary core and the secondary core by the primary winding.

In another aspect, a method of powering a gantry computed tomography (CT) system is provided. The method includes providing line-frequency alternating current (AC) input power to a primary side of a line-frequency rotary transformer on a stator of the gantry CT system. The method further includes inducing a line-frequency AC output power on a secondary side of the line-frequency rotary transformer on a gantry of the gantry CT system. The method further includes supplying the line-frequency AC output power to an X-ray source and an X-ray detector.

In yet another aspect, a gantry CT system is provided. The gantry CT system includes a line-frequency rotary transformer, a gantry, and a stator. The line-frequency rotary transformer includes primary and secondary cores. The gantry includes an X-ray source and an X-ray detector operable using line-frequency AC output power from the line-frequency rotary transformer. The gantry further includes a secondary side of the line-frequency rotary transformer coupled to the X-ray source and the X-ray detector. The stator includes a primary side of the line-frequency rotary transformer. The primary side is disposed adjacent to the secondary side to define an air gap between the primary and secondary cores. The primary side is configured to receive line-frequency AC input power and induce the line-frequency AC output power at the secondary side of the line-frequency rotary transformer.

DRAWINGS

These and other features, aspects, and advantages of the present disclosure will become better understood when the following detailed description is read with reference to the accompanying drawings in which like characters represent like parts throughout the drawings, wherein.

Figure 1:
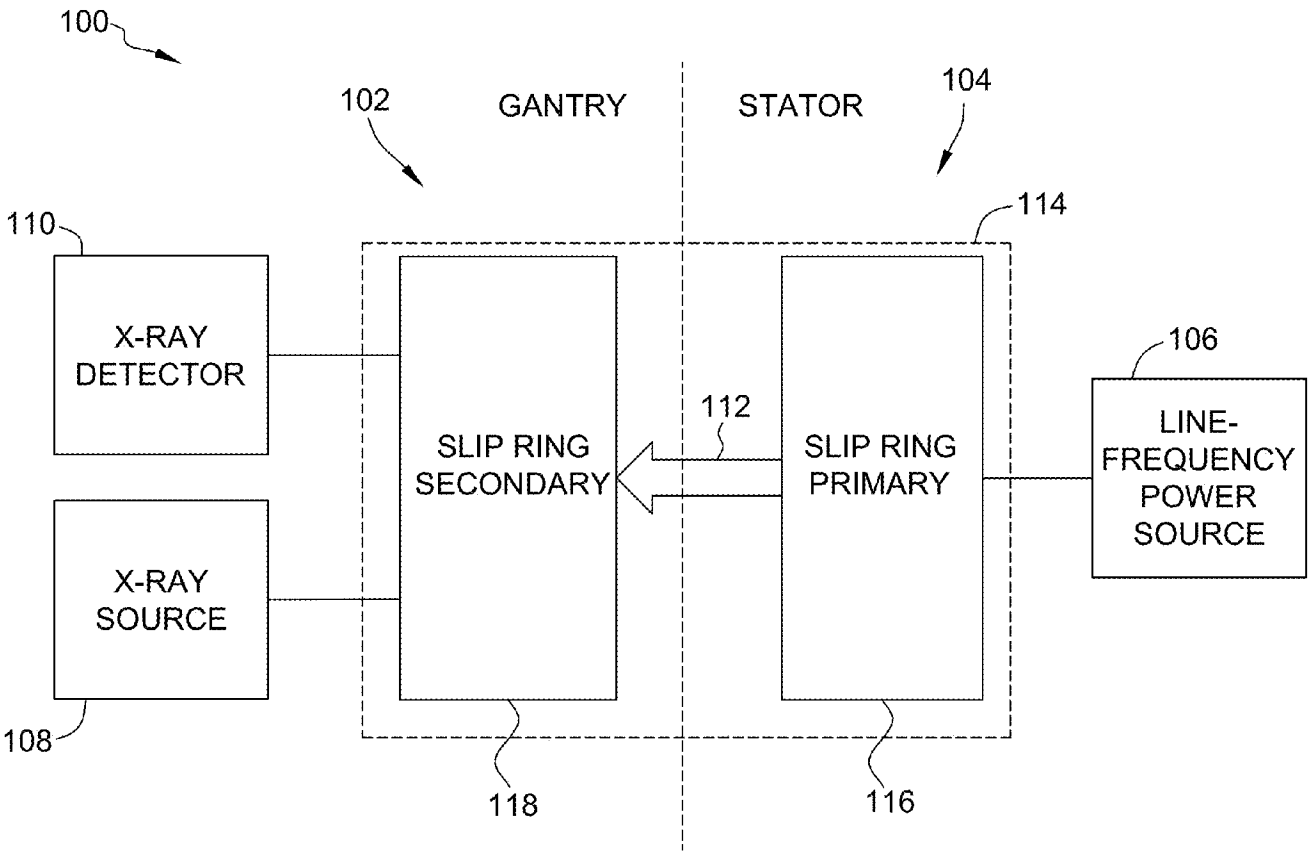
FIG. 1 is a block diagram of an exemplary embodiment of a gantry CT system.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, a number of terms are referenced that have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged. Such ranges are identified and include all the sub-ranges contained therein unless context or language indicates otherwise.

Contact slip ring devices are subject to wear and require frequent maintenance or replacement. Moreover, the sliding action causes the brushes to abrade and introduce particulate contamination into the system. Particulate contamination is generally conductive and can disrupt normal operations of nearby electronics.

Alternatively, a non-contact slip ring, or rotary transformer, may be utilized in gantry CT systems. It is realized herein that high-frequency rotary transformers utilize frequency boosting components, such as rectifier-inverter circuits to generate the frequencies compatible with the transformer materials. It is further realized herein the X-ray source and X-ray detectors typically utilize direct current (DC) or line-frequency, e.g., 50 Hz or 60 Hz, alternating current (AC) power. Consequently, the high-frequency power transmitted through the rotary transformer is converted back to DC or line-frequency at the gantry. The components necessary for these conversions introduce cost, complexity, and size to the CT gantry system.

Generally, transformers are designed to accept a certain amount of input power to generate a certain amount of output power in an efficient manner. Many transformers are also designed to minimize size and weight for a given application. In designing an efficient transformer, the transformer core should have a high magnetic permeability relative to that of a vacuum. This is referred to as relative magnetic permeability, which is a measure of magnetism a material obtains in response to an applied magnetic field. An efficient transformer should also have a high ratio of magnetizing inductance to leakage inductance, such as, for example, 1000:1, to minimize losses in the core and the windings.

A high magnetizing inductance is desirable because it generally results in lower magnetizing current and lower conductor losses. Conductor losses are reduced by reducing total current in the transformer, and by reducing the number of turns in the winding, which reduces winding resistance.

Magnetizing inductance in a transformer is proportional to the product of effective permeability and the square of the number of turns in the winding. The voltage induced in a winding is proportional to the rate of change in flux, which, for a fixed area, amounts to a change in flux density. For a given peak flux, the rate of change is proportional to the frequency. Consequently, the induced voltage is proportional to frequency. Conversely, when the frequency is reduced, a larger increase in flux is necessary to maintain that same voltage in the winding.

Low leakage inductance, i.e., low leakage flux, improves voltage regulation. Leakage flux degrades the proportional relationship of primary-to-secondary voltage in the transformer, particularly under heavy load. Leakage inductance is a function of the number of turns in the windings, which is directly related to the power rating and voltage regulation capability of the transformer. Fewer turns in the winding reduces leakage inductance and winding losses. Conversely, more turns in the winding increases leakage inductance and winding losses, and further degrades voltage regulation capability. Leakage inductance can be reduced by capacitance coupled in series with the windings.

It is realized herein the constraints on transformer size and weight are generally relaxed for gantry CT systems, because many X-ray source and X-ray detector components in the gantry demand less power than a transformer of suitable size for the gantry structure would ordinarily provide. Consequently, the operating flux density for a line-frequency rotary transformer is generally below saturation. It is further realized herein the air gap in a rotary transformer reduces the magnetizing inductance for the rotary transformer. Moreover, the low frequency of a line-frequency rotary transformer further reduces the magnetizing inductance and increases the magnetizing current.

It is further realized herein that the losses due to increased magnetizing current can be mitigated by increasing the number of turns in the winding. The increased number of turns reduces the flux necessary to induce a given voltage in the winding. The increased number of turns in the windings increases winding losses and leakage inductance, and degrades the voltage regulation capability of the transformer. The losses from increased magnetizing current are further reduced with the addition of a shunt capacitor across the secondary windings. The shunt capacitor affects a division of the magnetizing current, permitting a reduction in number of turns in the winding. It is realized herein that series capacitances on the primary and secondary windings can mitigate the increased leakage inductance. It is realized herein that a lower ratio of magnetizing inductance to leakage inductance is acceptable in a line-frequency rotary transformer for a gantry CT system than in conventional transformer design. Such a ratio may be 3:1 or lower in certain embodiments. It is further realized herein the resulting transformer losses and degraded voltage regulation are acceptable in a gantry CT system.

FIG. 1 is a block diagram of an exemplary embodiment of a gantry CT system 100 having a gantry 102 and a stator 104. Stator 104 includes stationary components of gantry CT system 100, including a line-frequency power source 106 that powers gantry CT system 100. Gantry 102 is rotatably coupled to stator 104, facilitating gantry 102 and its components turning about stator 104. Gantry 102 includes an X-ray source 108 and an X-ray detector 110. X-ray source 108 generates X-ray signals that are used by gantry CT system 100 to interrogate an object. X-ray detector 110 detects the generated X-ray signals as they pass through, pass by, reflect, deflect, or otherwise interact with the object being interrogated.

X-ray source 108 and X-ray detector 110 require power to operate. Generally, components of gantry 102, such as X-ray source 108 and X-ray detector 110, utilize DC or line-frequency AC gantry power 112. Due to the rotating relationship between gantry 102 and stator 104, gantry power 112 is delivered from stator 104 to gantry 102 through a slip ring 114. Slip ring 114 provides an electrical connection between stator 104 and gantry 102 using a primary ring 116 and a secondary ring 118. Generally, a slip ring provides such an electrical connection using a contact connection or a non-contact connection, such slip rings respectively referred to as contact slip rings and non-contact slip rings. In the exemplary embodiment of FIG. 1, slip ring 114 is a non-contact slip ring utilizing a rotary transformer to transmit gantry power 112 from primary ring 116 to secondary ring 118.

Figure 2:
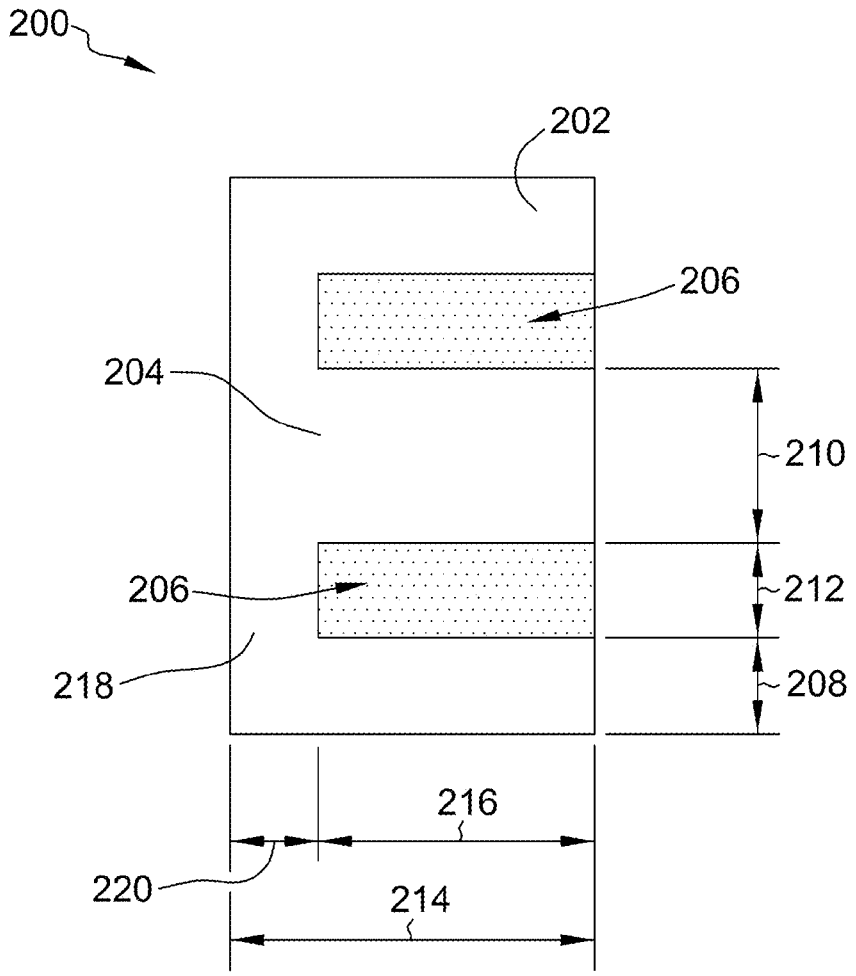
FIG. 2 is a cross-sectional diagram of an exemplary embodiment of an E-core for a line-frequency rotary transformer for use in the gantry CT system shown in FIG. 1.

FIG. 2 is a cross-sectional diagram of an exemplary embodiment of an E-core 200 for a line-frequency rotary transformer for use in gantry CT system 100 (shown in FIG. 1). E-core 200 is preferably manufactured of a material having high relative permeability, such as, for example, silicon steel, Metglas, Iron, Permalloy or other suitable material. E-core 200 includes side posts 202 and a center post 204. Side posts 202 are separated from center post 204 by air gaps 206, all of which are arranged in the form of the letter "E." Side posts 202 have a side post width 208 of 1 unit, while center post 204 has a center post width 210 of 2 units. Air gaps 206 separating side posts 202 and center post 204 have a gap width 212 of 1 unit. E-core 200 has a total length 214 of 4 units. Of total length 214, side posts 202 and center post 204 have post lengths 216 of 3 units, while a backplane 218 has a backplane length 220 of 1 unit. The precise dimensions of E-core 200 are scalable as each implementation requires and are largely dependent on power requirements. The ratios among the various dimensions are chosen at least partially to simplify manufacturing of E-core laminates.

Figure 3:
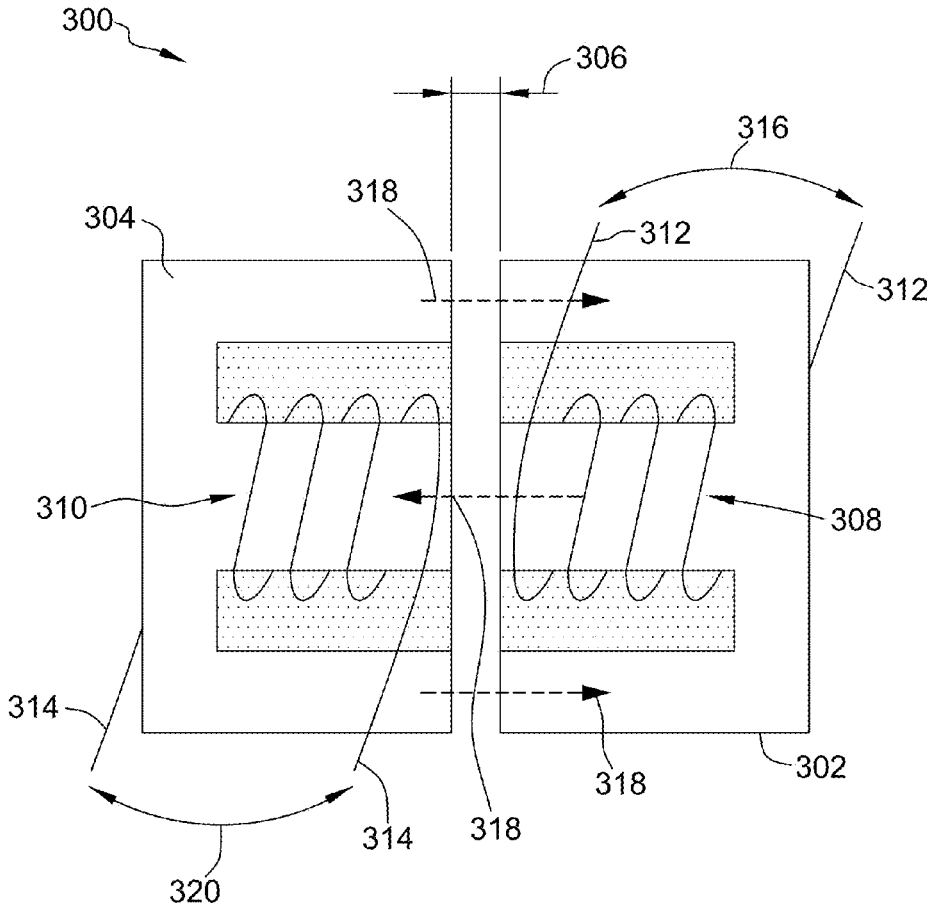
FIG. 3 is a cross-sectional diagram of an exemplary embodiment of a line-frequency rotary transformer for use in the gantry CT system shown in FIG. 1.

FIG. 3 is a cross-sectional diagram of an exemplary embodiment of a line-frequency rotary transformer 300 for use in gantry CT system 100 (shown in FIG. 1). Line-frequency rotary transformer 300 includes a primary core 302 and a secondary core 304. Primary core 302 and secondary core 304 are E-cores separated by an air gap 306. In certain embodiments, air gap 306 is 0.5 millimeters to 5 millimeters. For example, in one embodiment, air gap 306 is preferably 2 millimeters, but may vary from 1 millimeter to 3 millimeters over the entirety of line-frequency rotary transformer 300. The relative magnetic permeability of air gap 306 is lower than that of primary core 302 and secondary core 304. Consequently, the relative magnetic permeability of line-frequency rotary transformer 300 as a whole is reduced and leakage inductance is increased. More specifically, as air gap 306 widens leakage inductance and losses increase.

Each of primary core 302 and secondary core 304 include multiple E-core laminates arranged into rings. In certain embodiments, the primary ring is assembled as several arc-sections of E-core laminates. The arc-section construction simplifies assembly of each of primary core 302 and secondary core 304. In certain embodiments, the multiple E-core laminates of primary core 302 and secondary core 304 are interleaved with non-conductive spacers to reduce the weight of line-frequency rotary transformer 300.

Line-frequency rotary transformer 300 includes a primary winding 308 and a secondary winding 310. Primary winding 308 includes primary terminals 312 and, likewise, secondary winding 310 includes secondary terminals 314. When a line-frequency input voltage 316 is applied to primary terminals 312, magnetic flux 318 is induced and flows through a magnetic circuit defined by primary core 302, air gap 306, and secondary core 304. Magnetic flux 318 induces a line-frequency output voltage 320 at secondary terminals 314.

Figure 4:
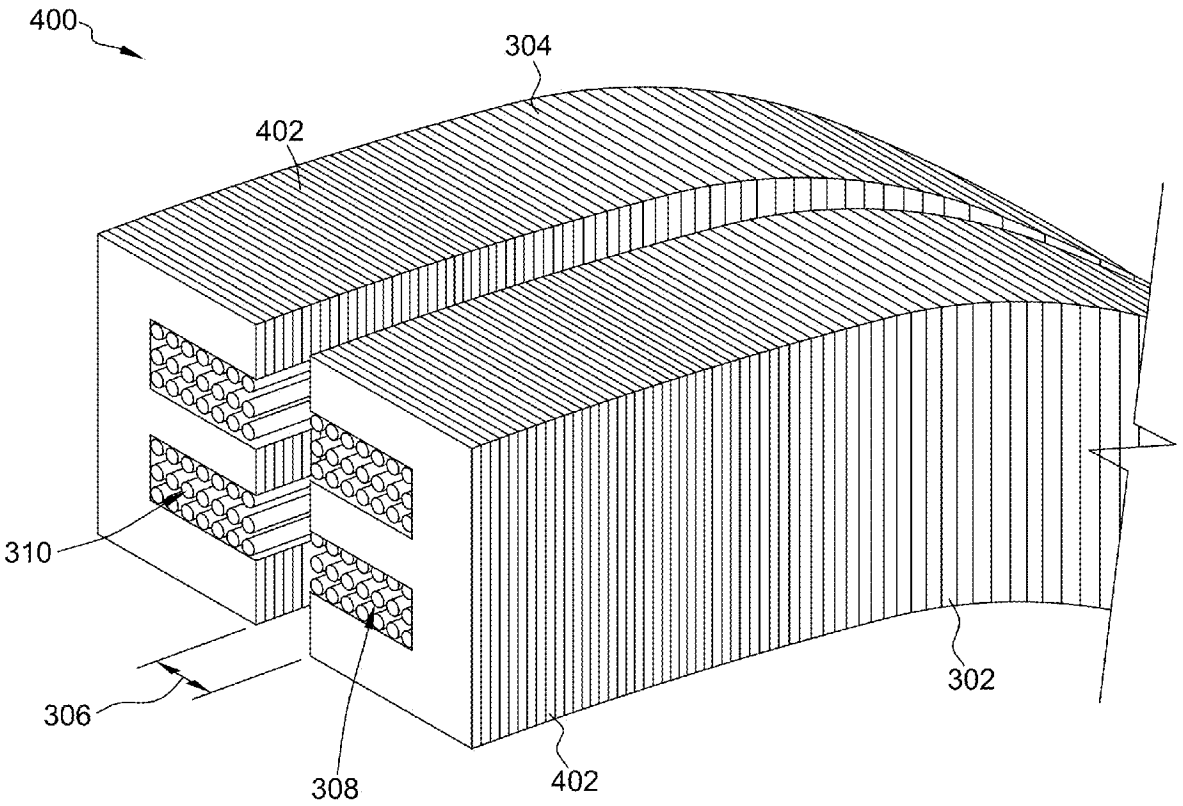
FIG. 4 is a perspective diagram of an exemplary arc-section of the line-frequency rotary transformer shown in FIG. 3.

FIG. 4 is a perspective diagram of an arc-section 400 of line-frequency rotary transformer 300 (shown in FIG. 3). Arc-section 400 includes primary core 302 and secondary core 304, each including multiple E-core laminates 402. E-core laminates 402, in certain embodiments, includes silicon steel E-core laminates interleaved with non-conductive spacers. In other embodiments, E-core laminates 402 include only E-core laminates manufactured from silicon steel or any other suitable material having a high relative magnetic permeability. As illustrated in FIG. 4, primary core 302 and secondary core 304 are separated by air gap 306. Further, arc-section 400 includes primary winding 308 and secondary winding 310.

Figure 5:
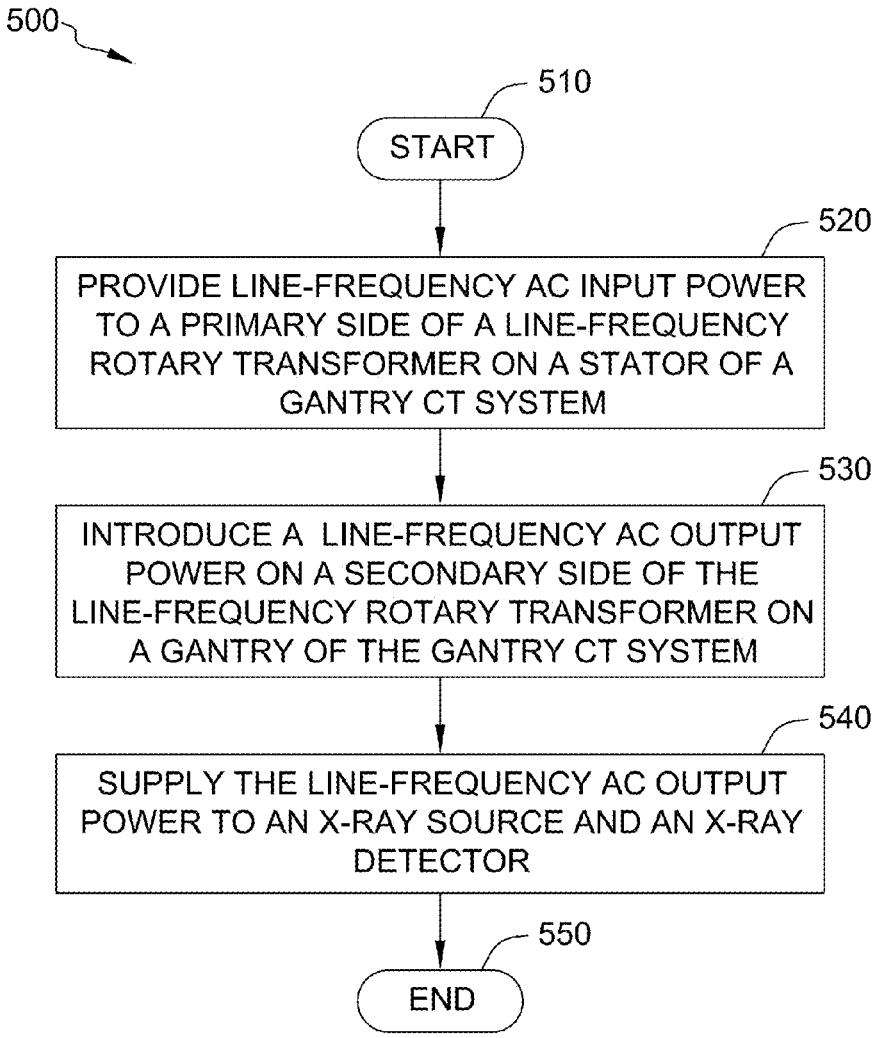
FIG. 5 is a flow diagram of an exemplary method of providing power to the gantry CT system shown in FIG. 1.

FIG. 5 is a flow diagram of an exemplary embodiment of a method 500 of providing power to gantry CT system 100 using line-frequency rotary transformer 300 (shown in FIGS. 1 and 3, respectively). Method 500 begins at a start step 510. At a stator power step 520, line-frequency AC input power is provided to a primary side of line-frequency rotary transformer 300 at stator 104. More specifically, line-frequency input voltage 316 is applied to primary terminals 312 of primary winding 308, which induces magnetic flux 318 in primary core 302 and secondary core 304.

At an inductions step 530, magnetic flux 318 flowing through primary core 302 and secondary core 304 induces line-frequency AC output power at a secondary side of line-frequency rotary transformer 300 at gantry 102. More specifically, line-frequency output voltage 320 is induced across secondary terminals 314 of secondary winding 310.

At a gantry power step 540, the line-frequency AC output power is supplied to X-ray source 108 and X-ray detector 110. Method 500 ends at an end step 550.

Figure 6:
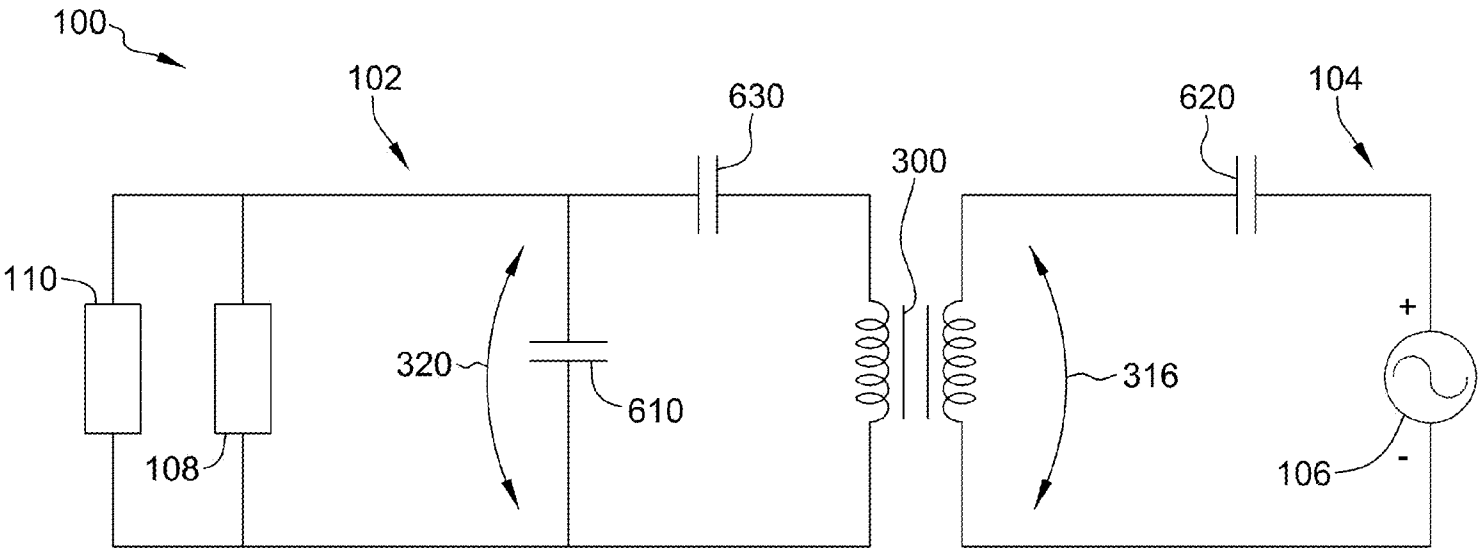
FIG. 6 is a schematic diagram of the gantry CT system shown in FIG. 1.

FIG. 6 is a schematic diagram of gantry CT system 100 and line-frequency rotary transformer 300 (shown in FIGS. 1 and 3, respectively). Gantry CT system 100 includes stator 104 and gantry 102 on opposite side of the schematic, coupled by line-frequency rotary transformer 300. Line-frequency AC power source 106 is illustrated an AC voltage source coupled across primary winding 308 of line-frequency rotary transformer 300. Line-frequency AC power source 106 delivers line-frequency AC input voltage 316 to primary winding 308.

Likewise, gantry 102 includes X-ray source 108 and X-ray detector 110 illustrated as loads. Line-frequency rotary transformer 300 supplies line-frequency AC output voltage 320 to X-ray source 108 and X-ray detector 110. Gantry 102 further includes a shunt capacitor 610 across secondary winding 310 of line-frequency rotary transformer 300. Gantry 102 and stator 104 further include series capacitors 620 and 630 coupled in series with primary winding 308 and secondary winding 310. Capacitors 620 and 630 mitigate the effects of leakage inductance in line-frequency rotary transformer 300.

An exemplary technical effect of the methods, systems, and apparatus described herein includes at least one of: (a) improving gantry power quality by use of a non-contact slip ring for power transmission to the gantry; (b) reducing maintenance cost by use of the non-contact slip ring; (c) reducing necessary rectifiers, inverters, and transformers on the stator and gantry for converting to and from line-frequency AC power; (d) reducing weight on gantry by eliminating rectifiers, inverters, and transformers; and (e) reducing manufacturing costs of the gantry-stator slip ring.

Exemplary embodiments of methods, systems, and apparatus for line-frequency rotary transformers are not limited to the specific embodiments described herein, but rather, components of systems and/or steps of the methods may be utilized independently and separately from other components and/or steps described herein. For example, the methods may also be used in combination with other non-conventional line-frequency rotary transformers, and are not limited to practice with only the systems and methods as described herein. Rather, the exemplary embodiment can be implemented and utilized in connection with many other applications, equipment, and systems that may benefit from increased efficiency, reduced operational cost, and reduced capital expenditure.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A line-frequency rotary transformer, comprising:

a primary core comprising:

a first plurality of E-core steel laminates arranged in a first ring couplable to a stator, and a primary winding disposed within said first ring and configured to transmit line-frequency alternating current (AC) power; and a secondary core magnetically couplable to said primary core, said secondary core comprising:

a second plurality of E-core steel laminates arranged in a second ring couplable to a gantry rotatably couplable to said stator, and a secondary winding disposed within said second ring and configured to receive a line-frequency AC power induced in said secondary winding through said primary core and said secondary core by said primary winding.

2. The line-frequency rotary transformer of claim 1, wherein said primary winding is configured to transmit 60 Hz AC power to said secondary winding.

3. The line-frequency rotary transformer of claim 1, wherein said first plurality of E-core steel laminates is interleaved with non-conductive spacers to form said first ring.

4. The line-frequency rotary transformer of claim 1, wherein each E-core steel laminate of said first plurality of E-core steel laminates and said second plurality of E-core steel laminates comprises two side posts and a center post, said two side posts each having a width equal to half a center post width.

5. The line-frequency rotary transformer of claim 1, wherein said first ring is disposed adjacent to said second ring and separated therefrom by an air gap.

6. The line-frequency rotary transformer of claim 1, wherein said air gap has a width of 0.5 to 5 millimeters (mm).

7. The line-frequency rotary transformer of claim 6, wherein said first plurality of E-core steel laminates and said second plurality of E-core steel laminates have a magnetizing inductance to leakage inductance ratio of 3:1.

8. A method of powering a gantry computed tomography (CT) system, said method comprising:

providing line-frequency alternating current (AC) input power to a primary side of a line-frequency rotary transformer on a stator of the gantry CT system, the primary side including a primary core comprising a first plurality of E-core steel laminates arranged in a first ring couplable to the stator, and a primary winding disposed within the first ring and to which the line-frequency AC input power is supplied;

inducing a line-frequency AC output power on a secondary side of the line-frequency rotary transformer on a gantry of the gantry CT system, the secondary side comprising a secondary core magnetically couplable to the primary core, the secondary core comprising a second plurality of E-core steel laminates arranged in a second ring couplable to a gantry rotatably couplable to the stator, and a secondary winding disposed within the second ring and into which the line-frequency AC output power is induced; and supplying the line-frequency AC output power to an X-ray source and an X-ray detector.

9. The method of claim 8 further comprising disposing the secondary side of the line-frequency rotary transformer on the gantry adjacent to the primary side of the line-frequency rotary transformer on the stator to define an air gap between the primary side and the secondary side.

10. The method of claim 9, wherein the air gap has a width ranging from 1 millimeter to 3 millimeters.

11. The method of claim 8 further comprising rotating the gantry about the stator.

12. The method of claim 8, wherein providing the line-frequency AC input power comprises providing 60 Hertz AC power.

* * * * *